United States Patent [19]

Klomp

[11] Patent Number: 4,955,333

[45] Date of Patent: Sep. 11, 1990

[54] VARIABLE VOLUME CRANKCASE SCAVENGE CONTROL

[75] Inventor: Edward D. Klomp, Mount Clemens, Mich.

[73] Assignee: General Motors Corporation, Detroit, Mich.

[21] Appl. No.: 369,222

[22] Filed: Jun. 21, 1989

[51] Int. Cl.[5] ..... F02B 33/04

[52] U.S. Cl. ..... 123/73 AC; 123/73 AE

[58] Field of Search ..... 123/73 R, 73 AE, 73 AC

[56] References Cited

U.S. PATENT DOCUMENTS

| | | | |
|---|---|---|---|
| 1,021,791 | 4/1912 | O'Neill | 123/73 AE |
| 1,550,703 | 8/1925 | Knott | 123/73 AE |

FOREIGN PATENT DOCUMENTS

| | | | |
|---|---|---|---|
| 2547353 | 12/1984 | France | 123/73 AC |
| 0124020 | 7/1983 | Japan | 123/73 AE |
| 341523 | 1/1931 | United Kingdom | 123/73 AC |
| 523270 | 7/1940 | United Kingdom | 123/73 AC |

*Primary Examiner*—David A. Okonsky

*Attorney, Agent, or Firm*—Robert J. Outland

[57] ABSTRACT

A crankcase scavenged two cycle engine is provided with a supplemental variable volume chamber or plenum connected with the crankcase chamber for each cylinder to controllably vary the effective volume of the crankcase chambers and thereby control scavenging pressure. Control methods for providing more consistent scavenging and more efficient charge control are disclosed.

1 Claim, 3 Drawing Sheets

VARIABLE VOLUME CRANKCASE SCAVENGE CONTROL

TECHNICAL FIELD

This invention relates to two cycle engines and more particularly to control of crankcase scavenging for such engines.

BACKGROUND

In conventional crankcase scavenged two-stroke-cycle engines (two cycle engines) with piston controlled intake and exhaust ports, it is generally desired to minimize crankcase volume (CV). This maximizes the pressure ratio (PR) from the crankcase compression process. Pressure ratio (PR) equals the peak crankcase pressure divided by ambient pressure.

The relationship in a particular engine between PR and CV normalized by displacement (D) at one engine speed is shown in FIG. 1. A representative value of CV/D is also shown for reference. FIG. 2 shows how the crankcase pressure varies with crank angle for several engine speeds at the reference CV/D. Note that the peak pressure increases with speed as does the crank angle duration from peak pressure to ambient pressure.

An important design goal is to maximize engine power at the rated speed. Such a result follows from optimizing the scavenging process; however, if scavenging is optimized at rated speed, it will not be optimum at lower speeds unless the fluid mechanical process can be made similar. Such similarity requires that the ratio of fresh charge jet velocity to mean piston speed (JV/PV) be relatively constant and the duration of the blowdown process in crank angle degrees should not vary with speed.

FIG. 3 shows a representative variation of the ratio JV/PV over a speed range of interest and the corresponding variation of blowdown duration (BD) in crank angle degrees. As the engine speed is reduced from a maximum, the increase in JV/PV suggests relatively more rapid mixing of the jetting fresh charge with the expected result of a lower mass of trapped fresh charge. Decreasing the crank angle duration for blowdown as the engine speed is reduced suggests that a larger fraction of the fresh charge would enter at a smaller inlet port open area and this would very likely degrade the quality of the scavenging process.

SUMMARY OF THE INVENTION

The present invention provides means for varying the effective volume of the engine crankcase in order to control the crankcase peak pressure ratio PR. In one embodiment, the means is a supplemental chamber or plenum connected with the crankcase and having a movable piston to vary the connected volume of the chamber.

As the effective volume of the crankcase is increased, the pressure ratio PR is decreased. This change as a function of the volume/displacement ratio CV/D is shown in FIG. 1. FIG. 4 shows the required variations of CV/D at wide open throttle to maintain the volume ratio JV/PV constant over the indicated speed range in a particular case. This can be accomplished by the variable volume chamber previously suggested or by other means such as a segmented plenum connected by appropriate volumes.

As the pressure ratio PR is increased, the jet velocity JV is decreased, causing the blowdown duration to increase. Thus, varying the effective crankcase volume can vary jet velocity JV in a manner to maintain JV/PV constant and maintain optimum scavenging and maximum power over a wide range of engine speeds. Additionally, the reduced pressure ratio PR at lower speeds will result in a decrease in pumping work and thereby improve engine thermal efficiency.

Finally at any given speed, the crankcase volume CV can be increased until the mass flow per cycle is decreased. Thus, varying the crankcase volume can serve the same flow rate control function as a throttle but with much reduced pumping work.

These and other features and advantages of the invention will be more fully understood from the following description of a specific embodiment of the invention taken together with the accompanying drawings.

BRIEF DRAWING DESCRIPTION

DETAILED DESCRIPTION

Figure 1:
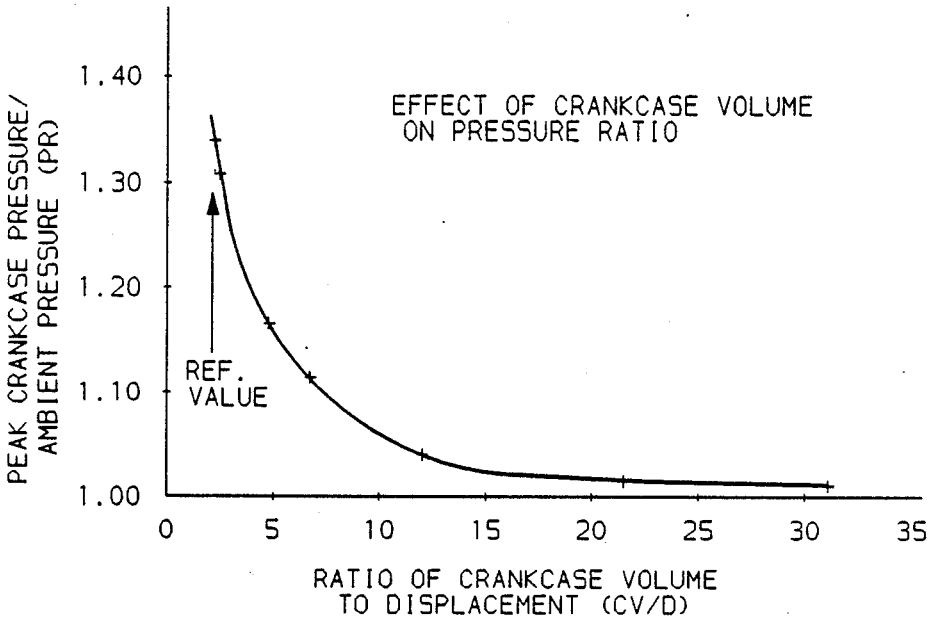
FIGS. 1–3 are graphical presentations of crankcase related information heretofore described for a conventional two cycle engine.
Figure 2:
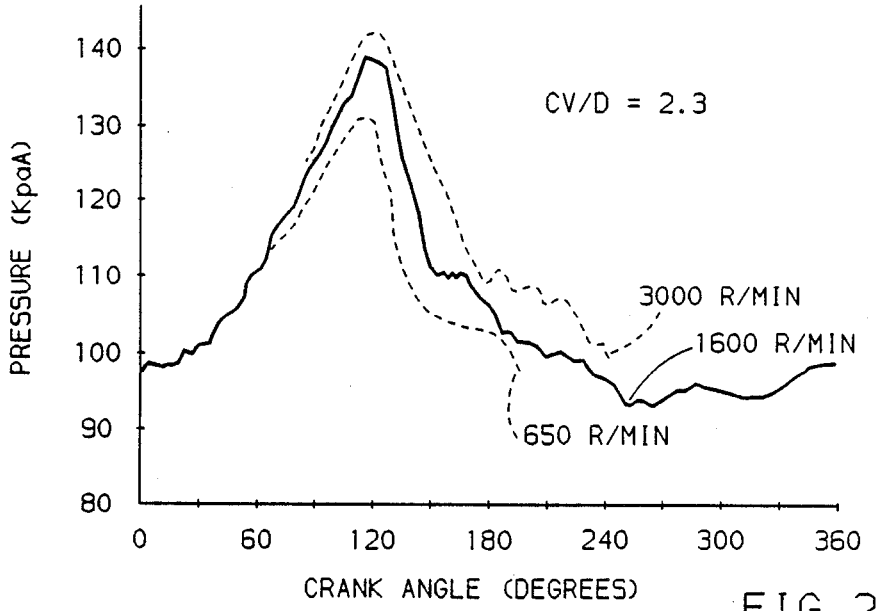
Figure 3:
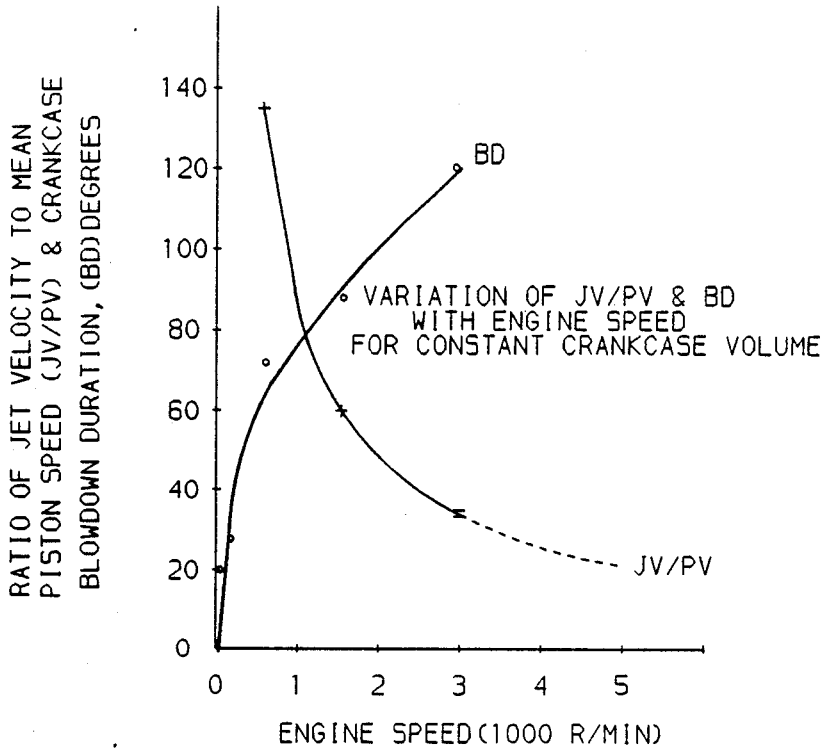

Referring now to the drawings in detail, numeral 10 generally indicates a crankcase compression two cycle internal combustion engine 10 according to the invention. Engine 10 conventionally includes a cylinder block 11 having multiple cylinders 12 only one of which is shown. A cylinder head 14 mounted on the top of the block 11 closes the outer ends of the cylinders and includes for each cylinder a combustion chamber recess 15 having an associated spark plug 16 and fuel injector 18.

In each cylinder 12 there is a reciprocable piston 19 connected by a connecting rod to one throw of a crankshaft 20 that is rotatably mounted in a crankcase chamber 22 located one below each of the cylinders. The chambers 22 are formed by the lower portion of the cylinder block 11 and a separable cover 23 attached to the block and are preferably made with the smallest possible volume to provide maximum crankcase compression in operation as is conventional in crankcase scavenged two cycle engines.

The crankcase conventionally mounts an air inlet manifold 24 on an inlet boss 26 having an inlet opening 27 for and into each crankcase chamber 22. A reed type inlet check valve 28 in each opening 27 prevents backflow of inlet air charges from the crankcase chambers to the manifold 24. One or more transfer passages 30 extending from inlet ports 31 connect an intermediate part of each cylinder with the crankcase and an exhaust port 32 connects the cylinder with an exhaust system.

In accordance with the invention, the engine further includes supplemental variable volume means 34 connected with the crankcase chambers 22. In one embodiment illustrated, means 34 includes a variable volume plenum 35 for and connected with each of the crankcase chambers 22. Each plenum 35 may comprise a cylinder-like container 36 having one wall thereof formed by an adjusting piston 38 to form a closed supplemental chamber 39 Suitable means such as pipe 40 having a control valve 42 connect each of the chambers 39 with its respective crankcase chamber 22. Adjustment of the piston 38 and control valve 42 may be by an operator or by other suitable means not shown.

In operation with the control valve 42 closed the engine operates conventionally, drawing air into the crankcase chambers 22 on the upstroke of their respective pistons and compressing the crankcase charge on the downstroke. As each piston nears bottom dead center, it first opens the respective exhaust port 32 allowing blowdown of burned combustion products from its cylinder. Shortly thereafter, the inlet ports 31 are opened, allowing pressurized air from the associated crankcase chamber 22 to pass through the transfer passages 30 into the cylinder 12, scavenging out the remaining combustion products and providing a fresh cylinder air charge.

In accordance with the invention, when the control valves 42 are opened, the volumes of the crankcase chambers 22 are supplemented by the variable volumes of their associated plenums 35. Accordingly, movement of the respective adjusting pistons 38 varies the effective crankcase chamber volume as desired.

Figure 4:
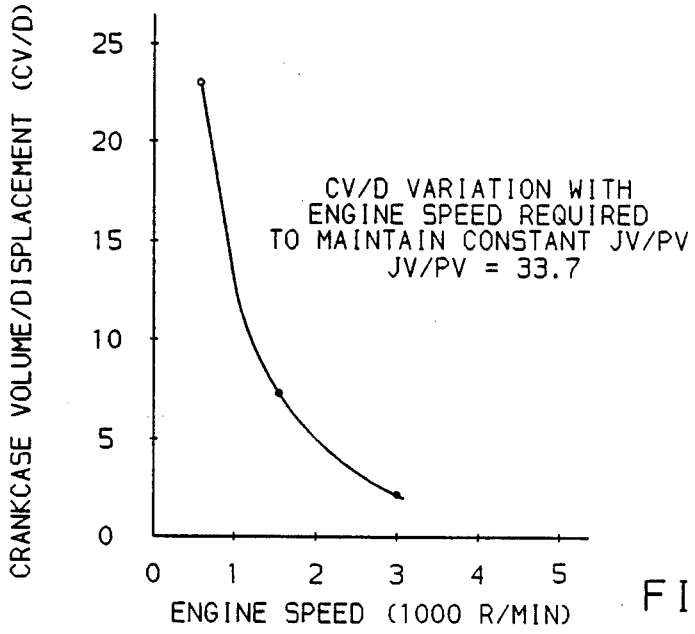
FIG. 4 is a graph of a heretofore described volume/-displacement relationship proposed for the present invention.
Figure 5:
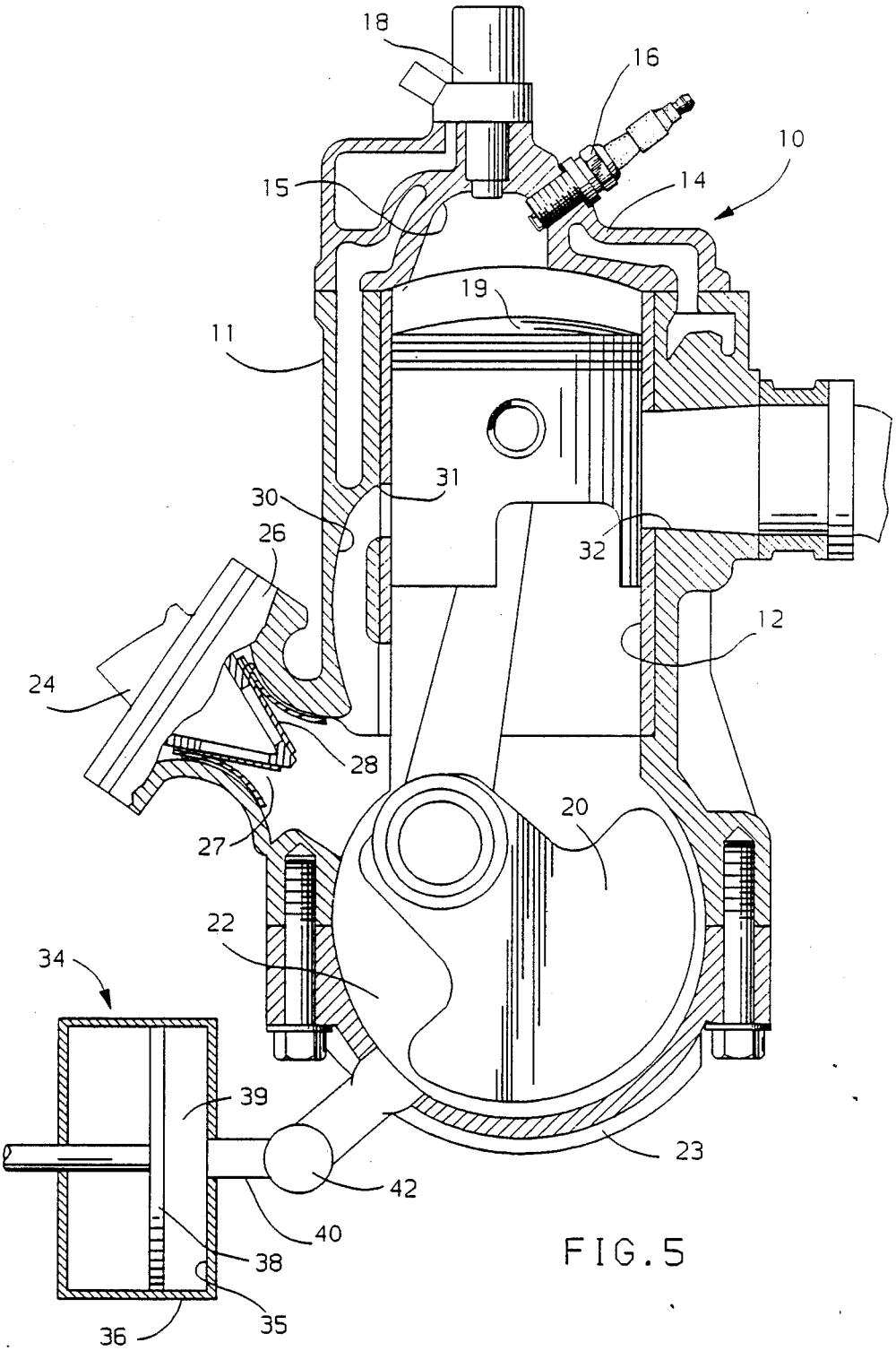
FIG. 5 is a partially schematic view illustrating variable volume crankcase scavenge control means according to the present invention.

Selection of the chamber 22 volume may then be used to control the effective crankcase compression and scavenging as previously indicated. If the crankcase chamber volume/cylinder displacement ratio CV/D is varied with engine speed in accordance with the characteristics of FIG. 4 determined for the particular engine involved, then the ratio of the scavenging blowdown jet velocity to the piston velocity will remain constant and more consistent cylinder scavenging at all speeds should result. Also, variation of the plenum 35 volume could be used to at least partially control the cylinder air charge and exhaust residuals left in the cylinders after scavenging and thereby substitute for throttling with greater efficiency through reduced pumping work as previously stated.

It should be apparent the many other possible forms of variable volume plenums could be provided in place of that shown without departing from the invention. For example, the plenums could be connected to the transfer passages 30 or to other portions of the crankcase chambers 22 and could be comprised of resilient walls supported, for instance, by variable fluid pressure, such as gas. Alternatively, spring loaded pistons could be employed with springs of adjustable compression. Perhaps a variable volume shroud below each piston could variably reduce the change in crankcase chamber volume on each piston stroke. Alternatively, the pistons in the supplemental chambers could reciprocate with varying phasings or stroke lengths relative to the engine pistons to vary the effective crankcase chamber volumes.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

The embodiments of the invention in which an exclusive property or privelege is claimed are defined as follows:

1. A two cycle engine having at least one cylinder with a piston carried for reciprocation therein, a closed crankcase at one end of each said cylinder and having a charge inlet, means defining a transfer passage between the crankcase and a distal portion of the cylinder, crank means for moving the piston in the cylinder between upper and lower positions in which the transfer passage is respectively blocked for compression of a charge in the crankcase and unblocked for transfer of a compressed charge from the crankcase to the cylinder for scavenging and charging the cylinder, a supplemental chamber having a portion connected with the crankcase for increasing the volume thereof, adjustable means in the supplemental chamber for varying the volume of the supplemental chamber portion connected with the crankcase to vary the effective volume of the crankcase, and the improvement comprising a control valve between each crankcase chamber and its respective supplemental chamber and operable to cut off or permit flow therebetween.

* * * * *